US007352284B2

(12) United States Patent
Krill

(10) Patent No.: US 7,352,284 B2
(45) Date of Patent: Apr. 1, 2008

(54) SECURITY MATERIAL AND FASTENERS THEREFOR

(75) Inventor: Jerry A. Krill, Ellicott City, MD (US)

(73) Assignee: The Johns Hopkins University, Baltimore, MD (US)

( * ) Notice: Subject to any disclaimer, the term of this patent is extended or adjusted under 35 U.S.C. 154(b) by 111 days.

(21) Appl. No.: 11/169,206

(22) Filed: Jun. 28, 2005

(65) Prior Publication Data

US 2007/0001844 A1 Jan. 4, 2007

Related U.S. Application Data

(60) Provisional application No. 60/583,335, filed on Jun. 28, 2004.

(51) Int. Cl.
*G08B 13/08* (2006.01)

(52) U.S. Cl. ..... 340/545.1; 340/545.3; 340/545.6; 340/545.8; 340/540; 340/541; 340/568.2

(58) Field of Classification Search ..... 340/545.1, 340/545.3, 545.6, 545.8, 540, 541, 539.1, 340/539.13, 550, 551, 552, 568.2; 307/147; 109/24

See application file for complete search history.

(56) References Cited

U.S. PATENT DOCUMENTS 4,843,375 A 6/1989 Riordan
5,677,674 A * 10/1997 Wolf ..... 340/541
6,215,397 B1 4/2001 Lindskog
6,244,081 B1 6/2001 Schlipper
6,400,268 B1 6/2002 Lindskog
6,686,539 B2 2/2004 Farquhar et al.
6,881,689 B2 4/2005 Cohee
7,064,667 B2 * 6/2006 Sosna ..... 340/568.7
7,174,277 B2 * 2/2007 Vock et al. ..... 702/188
2002/0084090 A1 7/2002 Farquhar et al.
2004/0066302 A1 * 4/2004 Menard et al.
2004/0195001 A1 10/2004 Farquhar et al.
2005/0275537 A1 * 12/2005 Kerr et al.
2006/0164239 A1 * 7/2006 Loda

* cited by examiner

*Primary Examiner*—Hung Nguyen
(74) *Attorney, Agent, or Firm*—Francis A. Cooch

(57) ABSTRACT

Security material such as cloth, either normal strength or armored, or fragile webbing into which electronic micro-devices are woven to detect and react to tampering of the monitored article at the scene or via a network. Also disclosed are fasteners that permit reuse of the cloth and webbing. Facilitates the monitoring of high value articles and facilities and automatically records or responds to tampering attempts to increase the level of security for personal and organizational uses.

32 Claims, 8 Drawing Sheets

SECURITY MATERIAL AND FASTENERS THEREFOR

CROSS-REFERENCE TO RELATED APPLICATIONS

This application claims the benefit of U.S. Provisional Application 60/583,335, filed Jun. 28, 2004 the entire contents of which are hereby incorporated by reference as if fully set forth herein, under 35 U.S.C. §119(e).

BACKGROUND OF THE INVENTION

1. Field of the Invention

The present invention relates to security material for use in detecting and preventing tampering with high value articles and facilities.

2. Background

There is an increasing concern about detection and prevention of tampering with such articles as computers, sensors, special materials, equipment cabinets, vehicles, and with facility entrances. Existing measures include anti-tamper circuits, locks, seals, and closed circuit monitoring. However, the first several of these can be countered and the third requires human involvement.

SUMMARY OF THE INVENTION

The invention is a material such as cloth or webbing with wired and wireless electronic circuits, accelerometers, and batteries woven into the article to be protected or monitored that provides a form of "feeling" and can respond in a number of ways including wireless alertment. The security cloth can be woven with reinforced fiber material to provide enhanced resistance to tampering. The webbing can be ephemeral, so that its presence cannot be detected by an intruder. The interwoven circuits detect attempts to break through the security cloth or webbing and can relay an alert, counter the intrusion attempt, or just record the tampering event for future download. Also disclosed are mechanisms for attachment, programming, and opening/closing the security cloth. The security cloth/webbing of the invention is more foolproof, and in general lighter and more convenient, than the prior art and does not require human involvement once activated.

BRIEF DESCRIPTION OF THE DRAWINGS

Various embodiments are described below with reference to the drawings.

DETAILED DESCRIPTION OF THE PREFERRED EMBODIMENT(S)

Figure 1:
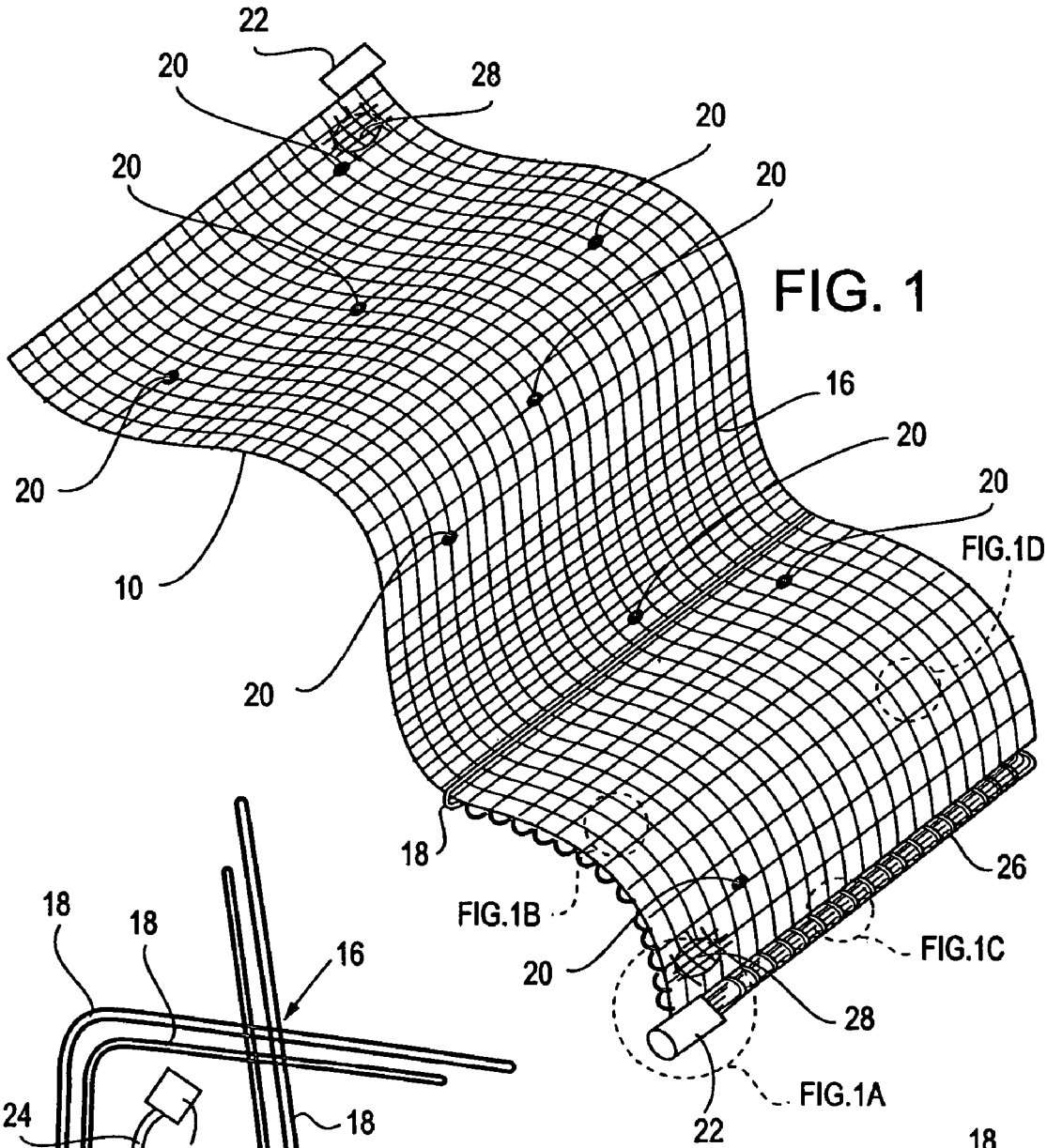
FIG. 1, consisting of FIGS. 1, 1A, 1B, 1C, and 1D, illustrates, respectively, the security cloth embodiment of the invention; four circuit loops and an accelerometer chip connected to an integrated circuit; conducting wire wrapped with reinforcing fiber; the end of a loop circuit in the cloth lining; and conducting wire as every n-th thread in the weave of the security cloth FIG. 2, consisting of FIGS. 2A, 2B, 2C, 2D, 2E, and 2F illustrates examples of how the security cloth embodiment of FIG. 1 can be attached to the article being protected including doors (FIG. 2A), safes and equipment storage drawers (FIG. 2B); padlocks (FIG. 2C); shipping containers (FIG. 2D); and laptop computers (FIGS. 2E and 2F).

FIG. 1 illustrates the security cloth 10 embodiment of the invention. It should be noted that the weave as shown in FIG. 1 is loose, in part, to permit better visualization of the invention. The invention can include such a loose weave giving the appearance of screen, netting, or gauze, or the weave can be much tighter such as any cloth with a high thread count.

Figure 1A:
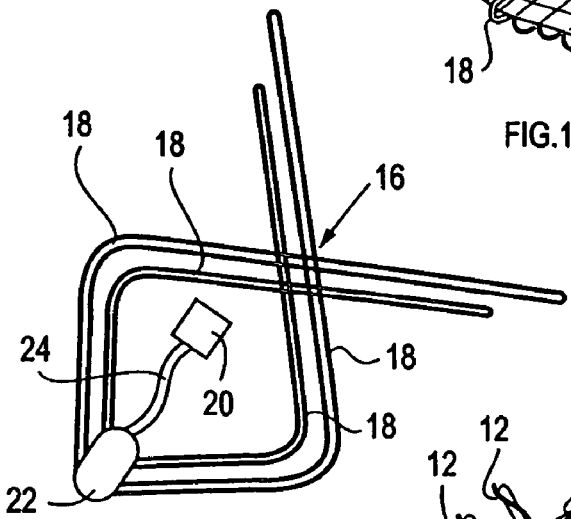
Figure 1B:
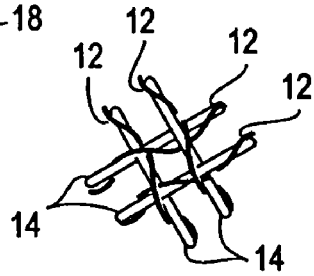
Figure 1C:
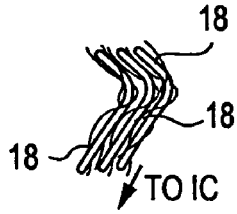
Figure 1D:
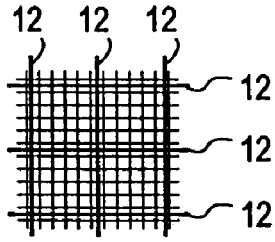

Some or all of the threads of the cloth are fine, coated conducting wires 12 (FIG. 1B) that are, as an option, wound around (based on relative stiffness) reinforcing fiber 14 (FIG. 1B) such as Kevlar® which permits the security cloth to act not only as a tamper alert but as armor as well. Either every thread is a conducting wire, perhaps wound around Kevlar® or other fiber, or only every n-th thread is a conducting wire (as shown in FIG. 1D). In addition to having the conducting wire wound around reinforcing fiber, the conducting wire and cloth can be "spun" together as single thread. FIG. 1D illustrates where the wire and cloth threads are considered as separate threads as they are interwoven, much like different colored cloth in apparel. The reinforcing fiber can also be a separate thread in the weave. As shown in FIG. 1A, the conducting wires are part of the weave 16 (FIGS. 1 and 1A) forming the cloth and forming circuit loops 18 (FIGS. 1 and 1A).

Embedded in the cloth (woven or glued in) are tiny accelerometer chips 20 (FIGS. 1 and 1A) that are electrically connected to the wire in both directions of the weave 16 for redundancy. The chips and all the conducting threads are electrically connected to one or more integrated circuits (ICs) 22 (FIGS. 1 and 1A) that monitor not only the tiny electrical current and/or voltage on each thread but also monitor the accelerometer chip readings (see 24 in FIG. 1A for lead from accelerometer chip to IC). The cloth lining 26 can be used to collect the conducting wire circuit loops which then, as previously noted, connect to an IC. FIG. 1C shows this in more detail.

One or more batteries 28 (FIG. 1) are woven into the fabric and are thereby protected by the fabric itself from tampering. An option is for direct power connection of the security cloth, but even in this case at least one backup battery would be woven in. The security cloth is expected to have very low power consumption except possibly when it is giving an alarm. Therefore, rechargeable batteries and backup batteries would sometimes be plugged into a charger connected to line power.

The security cloth 10, which can be camouflaged, or even made to appear decorative for esthetic or deceptive reasons, depending on the use, is attached to an article to be protected as illustrated in FIG. 2, for example, an opening (e.g., door (FIG. 2A), safe, or equipment storage drawer (FIG. 2B)). In one embodiment the cloth forms a bag that can envelop the protected article (e.g., a laptop computer, FIG. 2E wherein the invention is anchored into, e.g., a wall) or is placed around the protected article, for example, adhesive security cloth attached together via their sticky backsides (e.g., a padlock, FIG. 2C, although placing the padlock in a bag may also be practical).

Figure 2A:
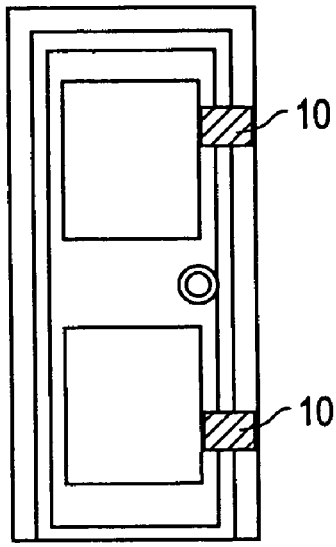
Figure 2B:
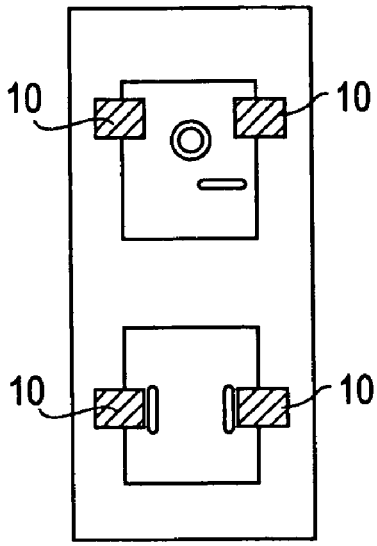
Figure 2C:
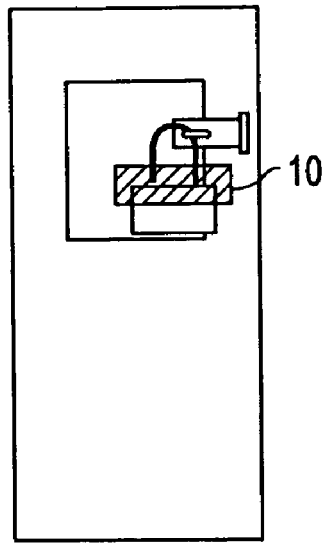
Figure 2D:
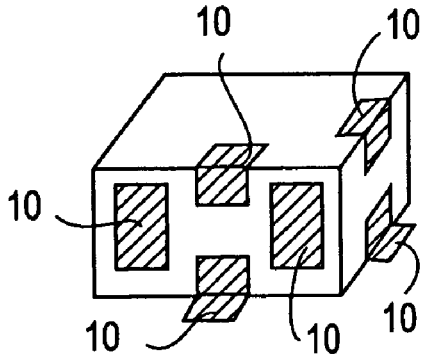
Figure 2E:
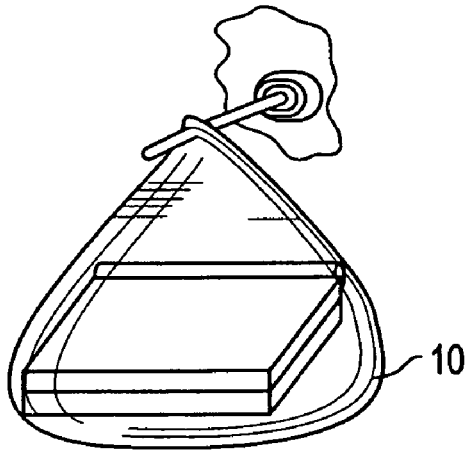
Figure 2F:
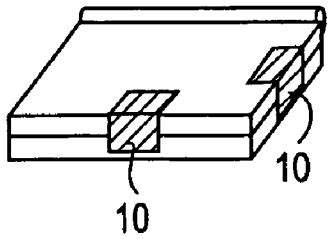

In another embodiment the cloth is strongly glued onto or woven into or otherwise attached to the article to be protected, such as a door, equipment storage drawer or computer cover (FIGS. 2A, 2B and 2F) or shipping container (FIG. 2D). Although not shown, the security cloth could be woven into clothing or designed into clothing itself as a means to protect people from violence or abduction.

In the case of the shipping container, not only can the security cloth of the invention be used on the container lid or other opening, but the security cloth could be applied in large patches to the sides of the container to monitor penetration of the sides and/or the cloth could attach the container to the surface on which it rests to ensure the container remains in place. For the webbing, as discussed below, a weak adhesive may be sufficient to attach the webbing, so that tampering will detach or otherwise disrupt the webbing but, in any event, the webbing can be substituted for the security cloth in the above examples. In this manner the ethereal webbing could be a "tripwire" in contrast to the deterrent, armored role of the cloth.

If there is an attempt to break or cut the security cloth, the accelerometers detect accelerations and the acceleration data is sent to the ICs for possible reaction. Also, the ICs monitor each of the conducting threads of the security cloth and determine if some pre-set number of circuits are broken. The ICs contain logic with criteria to conclude that tampering is occurring and to activate one or more pre-programmed alerts/responses.

For example, the determination that a tamper event is occurring is made by any such IC if one or more of the following occurs:

- n rows and m columns of wire circuits no longer carry current or a set voltage;
- p accelerometers indicate:
  - a. >15 g impulses (implying blows); or
  - b. >3 g extended activity (implying sawing or cutting); and/or
- line power cut to ICs (but each has their own battery backup).

Note: number of g's is for example only—any setting could be used.

If tampering is determined by the occurrence of one or more of the above-detected conditions, the following example response/alert options can be activated:

- silent wireless alert;
- audio/visual alarm;
- ignition or other power to the article being protected disabled; or
- activation of silent audio/visual recording of the tampering event.

For the case of wireless activation, the ICs would have very low power transmitters to a nearby cellular, wireless, or wired transmitter relay. For example, a new class of small autonomous node transmitters known as "motes" may be appropriate (see, for example, Sci. Am., June 2004 pp 85-91). If the article being protected is mobile, such as a vehicle or a container being transported, then the ICs may also be connected to GPS or inertial navigation (INS) circuits to allow reporting and update of location.

Figure 3:
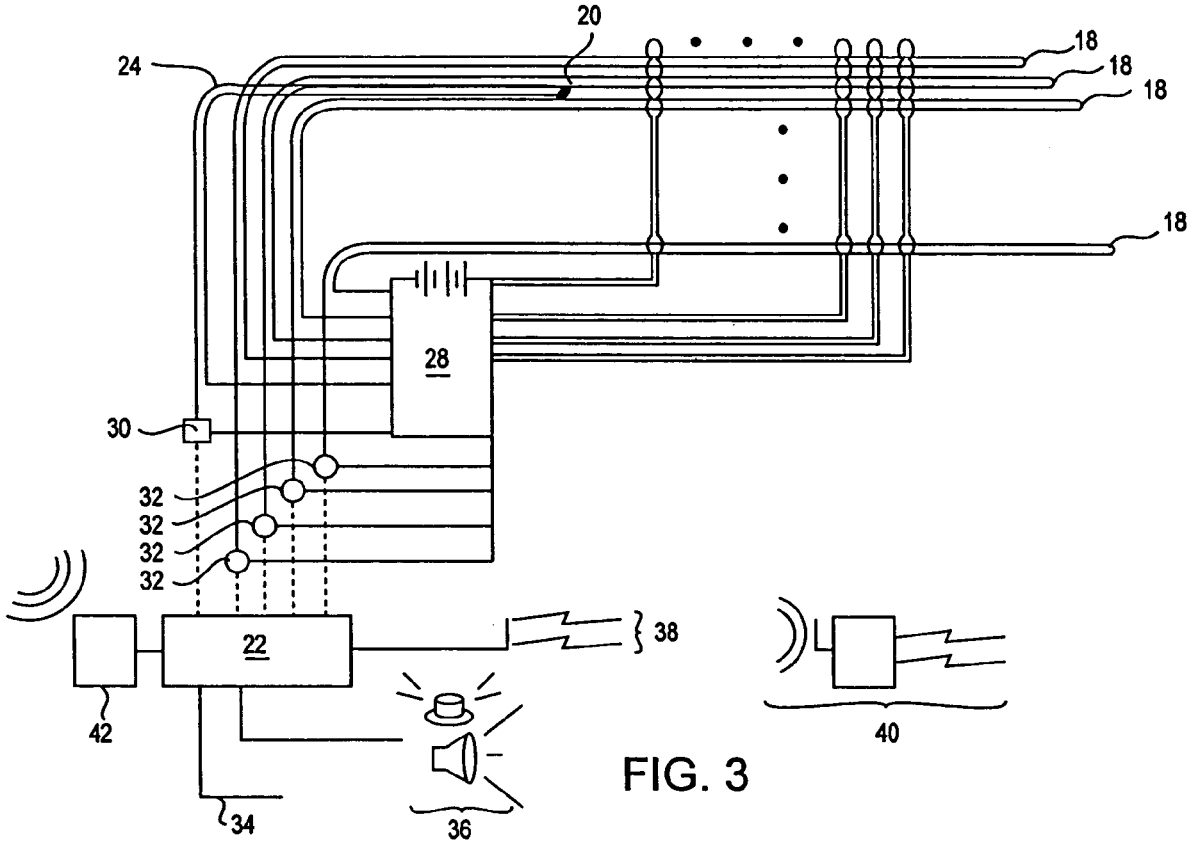
FIG. 3 illustrates the circuits and logic gates for the security cloth embodiment of FIG. 1.

FIG. 3 illustrates the circuits and logic gates for the security cloth of the invention. In addition to the circuit loops 18 formed by the interwoven coated conducting wires and the embedded accelerometer chips 20 (with electrical lead 24) and battery 28, the following can also be included: accelerometer signal monitor 30 for sending data to the IC with logic 22; and circuit monitor 32 for monitoring voltage and/or current and sending data to the IC with logic. Also shown in FIG. 3 are various response/alert options: line to a disablement (of the article's power) circuit 34; audio/visual alarm 36; low-power wireless alert and location signals 38; and a cellular wireless or line relay 40 to a network where audio and/or video recording of the tampering event can be initiated. Also shown is a GPS chip 42 for providing location data to the IC. The GPS component, as well as the IC with logic, could also be embedded in the fabric for protection and tamper monitoring.

Figure 4:
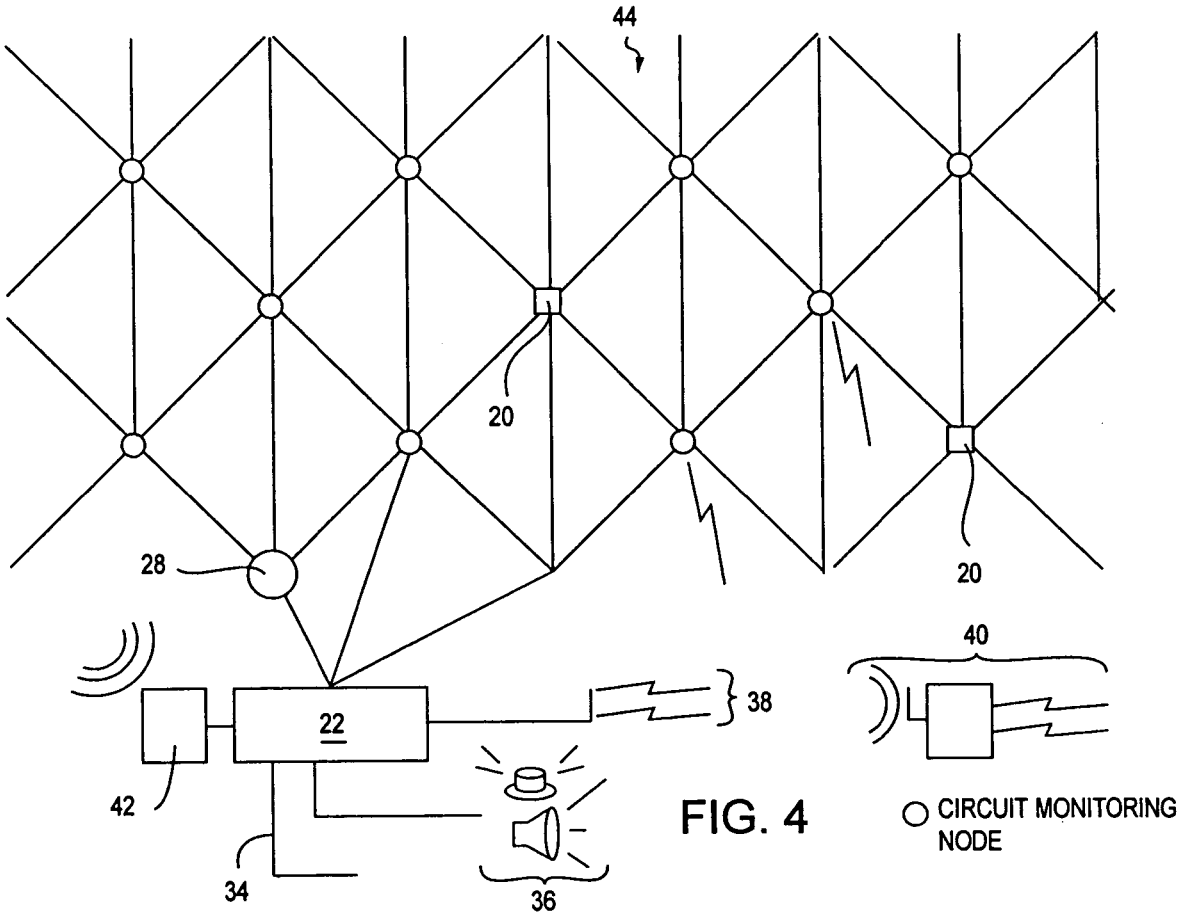
FIG. 4 illustrates the security webbing embodiment of the invention.

The security webbing is a variant of the security cloth embodiment described above. The security webbing embodiment 44 as shown in FIG. 4 provides more electrical interconnection for increased redundancy with the type of interconnecting (but conducting) threads with gauge selected depending on the required response. For example, the threads could be ultra-fine, coated, conducting filaments that can be easily broken, as a kind of trip-wire. When the circuits are broken, the ICs respond as identified above. This would appear similar to a spider web and the tampering can be reported with the tamperer unaware that the web is responding.

A stronger gauge of conducting, insulated wire thread of the security webbing embodiment has strong connecting wires that are not as easily broken and are harder to counter or deactivate because of the massively interconnected chips, analogous to neurological networks.

As shown in FIG. 4, accelerometer chips 20 and a battery 28 are embedded in the webbing as well as circuit monitoring nodes which are embedded in the webbing rather than being integrated into the logic IC 22 for the cloth. They are connected to the logic IC via a coded network protocol for reporting over the interconnected wires. An alternative is for each monitor node to possess a tiny ultra-low power wireless transmitter to transmit tamper events to the logic IC. As with the security cloth embodiment, FIGS. 2A-2F illustrate example applications for the webbing as well.

Once the logic IC receives data from the accelerometers and the monitor nodes and determines that tampering is occurring, the logic IC can initiate various pre-programmed responses/alerts similar to the security cloth alerts using the following: disablement (line to disablement circuit 34);

audio/visual alarm 36; low-power wireless alert and location signals 38; and a cellular wireless or line relay 40 to a network where audio and/or video recording of the tampering event can be initiated. As with the security cloth, also shown is a GPS chip 42 for providing location data to the logic IC which alternatively could be embedded in the webbing.

The security cloth and webbing embodiments discussed above could be used one time and discarded if they are sufficiently inexpensive products. In this case glue with strength beyond that of the cloth and webbing may be sufficient as a fastener. Further, the cloth and webbing could come pre-programmed or easily programmed with pre-set or custom settings of tamper detection thresholds and alertment responses and user authentication code.

However, at least initially, the security cloth and webbing of the inventions are probably expensive enough to warrant reuse. Therefore, FIGS. 5A-5I and 6A-6E illustrate a new type of fastener to lock and unlock two security cloths of the invention that together guard an opening such as a doorway or drawer. FIGS. 7A-7D illustrate methods for attaching the security cloth to the articles to be protected. Finally, FIGS. 8A-8B illustrate how common fasteners can be modified for cloth opening and closing, whether multi-use or one time use products.

Figure 5A:
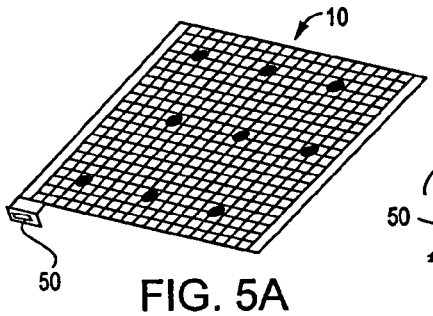
FIG. 5, consisting of FIGS. 5A, 5B, 5C, 5D, 5E, 5F, 5G, 5H, and 5I illustrates a claw-type fastener embodiment for the security cloth of FIG. 1 including, respectively, an example of the security cloth; security cloth with eyelets; the security cloth with the claw assembly; a biometric device and keypad for connection to the security cloth; a claw with pinhole; claw with notch in open position; claw with notch in closed position; claw with pinhole in closed position; and two swaths of security cloth joined by a claw assembly.
Figure 5C:
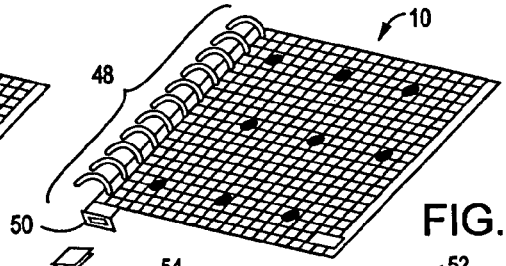
Figure 5D:
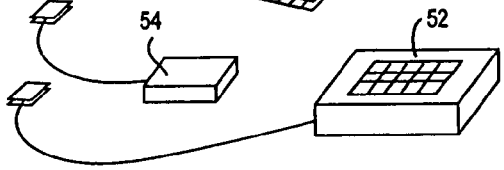

FIGS. 5A-5I illustrate a claw-type fastener embodiment (connector claw) for mechanically and electrically connecting the security cloth of the invention 10 to open or close in the same manner as a padlock. Either a swath of the security cloth (FIG. 5A) or a swath (all swaths shown with embedded accelerometers represented by the black dots) with eyelets 46 made of conducting material, e.g., brass, and with each eyelet electrically connected to a woven circuit (FIG. 5B) can be connected to another security cloth through the use of a connector claw assembly 48 (FIG. 5C). The security cloth is woven into the connector and electronically connected to the claws. The assembly consists of a number of "claws" all connected to an axle 49 (FIG. 5F) driven by a small electric motor (not shown) or small finger-operated crank (not shown).

Figure 5B:
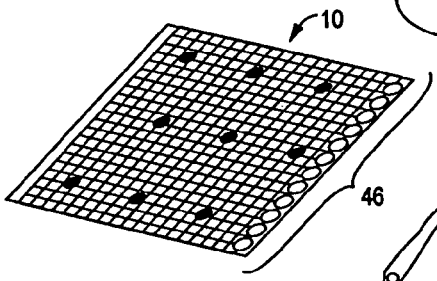
Figure 5E:
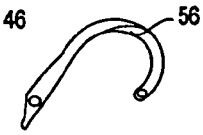
Figure 5F:
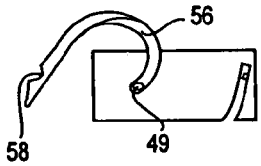
Figure 5H:
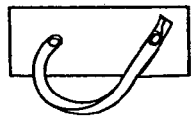
Figure 5G:
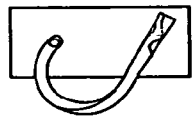
Figure 5I:
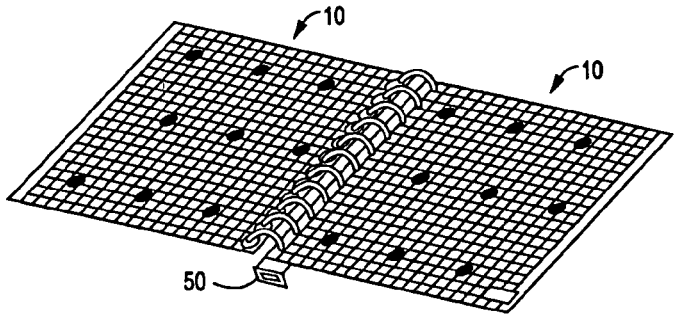

Upon activation, the claws close around the second piece of security cloth, either by penetrating through the weave of FIG. 5A or closing through the conducting loops of FIG. 5B as shown in FIG. 51. With FIG. 5A the two cloths remain separate circuits that could each be activated separately. For the case shown in FIG. 51, the conducting weaves are electrically interconnected through the conducting eyelets and via the claws to operate as a single security cloth. Using the connector claws, two security cloths can be bonded to the sides of a lid or door, for example, and connected or disconnected as the door/lid is locked and then opened, respectively.

The connector claw assembly can be of variable width (and corresponding variable number of claws) depending on the width of the security cloth. It is anticipated that the security cloth may come in different sizes in accordance with the sizes of the articles to be secured (like band aids). The security cloth may be custom programmed and a unique operator authentication code inserted via an interface, such as a USB port 50 (see FIGS. 5A and 5C), to which a computer or unique keypad 52 (FIG. 5D) can be connected. The keypad or computer using the interface provides selection of the alert criteria and options described above to be selected and the user password inserted. A biometric device 54 (FIG. 5D) could be connected as an option to allow registry of a thumbprint, for example, as a basis for opening and closing the fastener.

In the above examples it is assumed that the connector claws assembly contains, or is near, the logic IC where the tamper detection and alertment functions are performed. Thus, the USB connector is shown as part of the connector assembly in the figure. If the security cloth does not contain a connector claw assembly, the USB or other electronic interface port could be woven into the cloth (for protection) near the logic IC that it interfaces.

FIGS. 5E-5H also illustrate how the individual claws grab the second cloth and lock into place. In one embodiment (FIG. 5F), each claw 56 has a notch 58 that is engaged in the claw housing (FIG. 5G) when the motor has rotated the claws around the axle. This is analogous to the mechanical locking mechanism of a padlock, only much smaller. A locking mechanism (not shown) could also be added to prevent the notch from disengaging thereby locking the claw in place. The claw is also relatively sharp as a means to find its way between threads of the weave pattern of the security cloth it grabs. The other embodiment (FIG. 5E) is more sophisticated with each claw possessing a hole, in place of the notch, analogous to the eye of a needle. When the claw is rotated around, through the security cloth and into its locking slot (FIG. 5H), small pins on one or both sides of the eye are slid through the eye to secure the claw as shown, for example, in FIGS. 6B-6E.

Figure 6A:
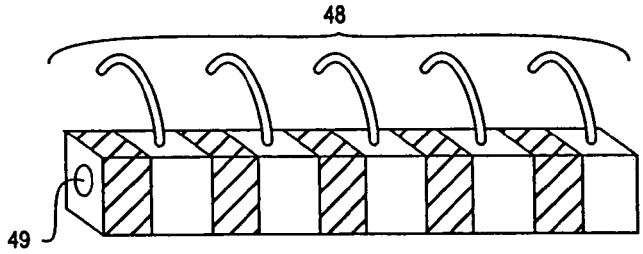
FIG. 6, consisting of FIGS. 6A, 6B, 6C, 6D, and 6E, illustrates an electro-active polymer (EAP) material or electromagnetic solenoid for use with the claw-type fastener embodiment of FIG. 5 including, respectively, a claw assembly; claw in closed position in locking slot using EAP with pins not inserted; claw in closed position in locking slot using EAP with pin inserted; electromagnetic solenoid and pin assembly in locking slot without claw; and claw in closed position in locking slot using an electromagnetic solenoid with pin inserted.
Figure 6B:
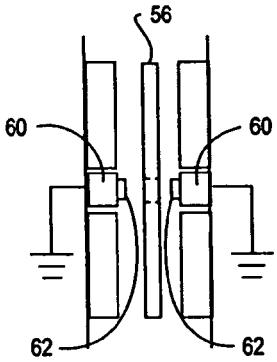
Figure 6C:
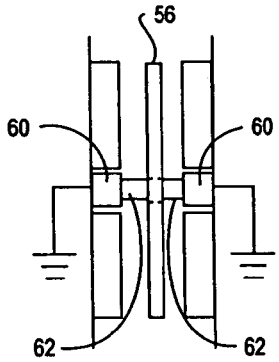
Figure 6D:
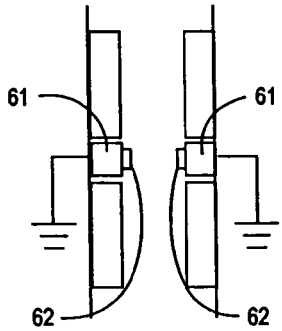
Figure 6E:
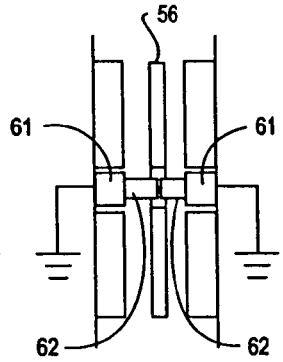

In the FIGS. 6B-6C, electro-active polymer (EAP) material activated piston 60 is used to insert the pins into the hole of the claw as discussed above. The EAP material is electrically activated by voltage in accordance with the disclosure contained in U.S. patent application Ser. No. 10/892,910, filed Jul. 16, 2004 and Ser. No. 10/892,908, filed Jul. 16, 2004, both of which are incorporated by reference herein in their entirety. In FIGS. 6D-6E an electromagnetic solenoid is used in place of the EAP activated piston where current is applied to activate the solenoid. FIGS. 6A-6E illustrate the EAP and solenoid configuration in more detail.

FIG. 6A illustrates the connector claw assembly 48 connected to an axel 49 connected to a motor (not shown) or finger crank (not shown). When the motor or finger crank moves the claws to the closed position in their respective locking slots (FIG. 5H), pins can be inserted in a hole in the claw to secure it. FIG. 6D shows the empty locking slot for the claw with the pins 62 and the electromagnetic solenoid 61. In FIG. 6B, the claw 56 is in the locking slot but the pins have not yet been inserted. As discussed above, once the EAP activated piston 60 has been electrically activated by the application of a voltage, the EAP activated piston pushes the pins into the hole in the claw thereby locking the claw securely into place (FIG. 6C). The EAP pistons could be replaced by more conventional small electromagnet solenoids 61 as shown in FIGS. 6D and 6E or other types of activated plunger, but at a likely increase in weight and size.

Figure 7A:
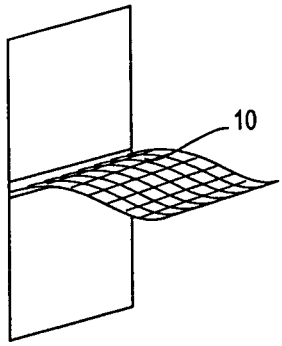
FIG. 7, consisting of FIGS. 7A, 7B, 7C, and 7D, illustrates various means for securing the security cloth or webbing of the invention to the article being monitored including, respectively, glue, weaving, claw assembly, and bag with anchor.
Figure 7C:
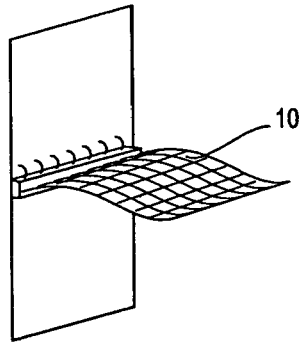
Figure 7B:
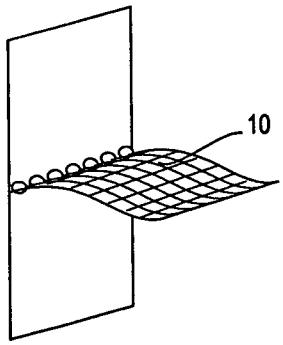

FIGS. 7A-7D illustrate various means for securing the security cloth or webbing of the invention to the article to be monitored. In FIG. 7A a strong glue, exceeding the strength of the cloth or webbing, bonds the security cloth to the article. FIG. 7B illustrates the security cloth 10 woven directly into the object to be secured. For example, a metal drawer could have a linear series of holes so that the weaving of the thread would encompass the edge of the drawer, through the holes, while the drawer and cloth were being manufactured. Not shown is security cloth that has an adhesive backing that is wrapped around the article or a portion thereof such that the adhesive backings are adhesively connected back to back.

FIG. 7C illustrates the use of the connector claw assembly itself used to embed the claws into the article if it consists of a soft material such as a wood or plastic door or drawer. Again, it is assumed that the claw would be a stronger connection to the article than the security cloth alone. In this way, an intruder would be more likely to disturb the cloth even if they tried to attack just the connector.

Figure 7D:
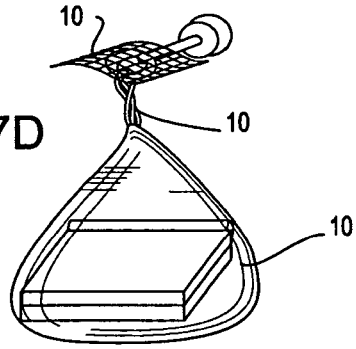
Figure 8A:
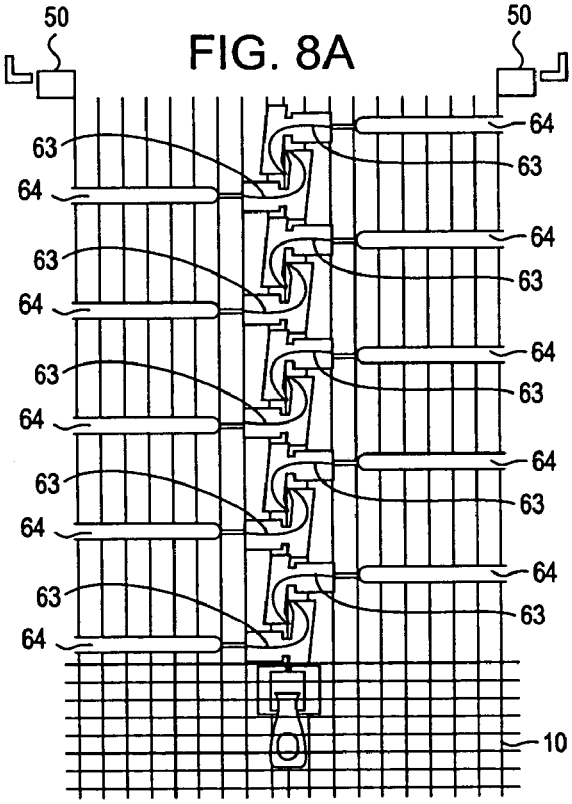
FIG. 8, consisting of FIGS. 8A and 8B, illustrates example modifications to normal fasteners, that is, respectively, zippers and buttons, for use with the security cloth of the invention.
Figure 8B:
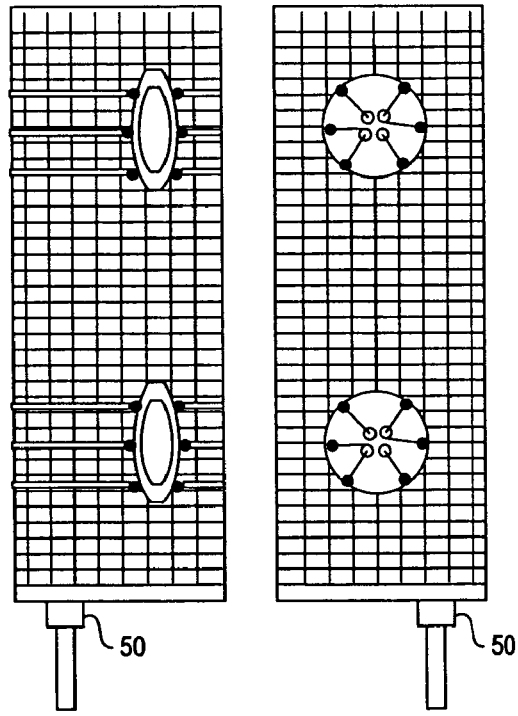

FIG. 7D is a cloth bag enveloping an article to be protected, such as jewelry. The top of the bag is just the cloth twisted into a rope and tied or woven onto a strong anchor to prevent the bag from being carried away. The anchor can, itself, be clothed in the cloth or webbing so that tampering with the anchor itself would cause an alert by the cloth.

FIGS. 8A-8B illustrate more conventional forms of fasteners that may be less secure than the claw embodiment described above but are, perhaps, less expensive to manufacture. FIG. 8A is a zipper, metal or nonmetal, with special conducting channels 63 to cross-connect the circuits 64 of the security cloths being zipped together. Of course, a standard zipper could be used but the circuits would necessarily remain separate circuits and the zipper would then require protection from unauthorized opening, e.g., via security cloth or webbing. Note that the illustration of connecting circuits shows parallel connections of circuits 64, rather than series connections, so that even unzipped, the separate circuits could continue to operate.

The security of the zipped security cloth would rely on the locking cover over the zipper "grip"—activated by a key code, combination, or USB port 50 connection to send the user password to the lock mechanism. The zipper grip could also be covered by a segment of security cloth 10 or webbing as shown in FIG. 8A. A simple alternative is to leave the zipper unlocked with the interconnected security cloth raising an alarm if unzipped, unless the user password were first entered via an interface.

FIG. 8B shows buttons with electrical contact points (indicated by the black dots) on their underside to enable parallel connection of separate security cloths. The buttons would engage the security cloth (assuming activation by user password via USB port 50 as described above which can also be used to program the logic ICs in the security cloth). If the buttons are unbuttoned, the broken circuits between the security cloths would cause an alarm, unless a user password is first entered through the USB port into the logic IC embedded in the cloth. The buttons could also be covered by sections of security cloth or webbing. The button contact points could be spring-loaded contacts or pins if necessary in order to ensure connectivity.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A security material for protecting an article from tampering comprising:

a cloth woven of a plurality of threads, one or more of the plurality of threads comprising a conducting wire, the conducting wire carrying an electrical current and/or voltage;

an integrated circuit electrically connected to each of the one or more conducting wires for monitoring the conducting wires, the integrated circuit containing logic for determining whether tampering is occurring and activating one of a plurality of pre-programmed alerts, the integrated circuit logic being programmable to prevent false alarms; and a plurality of accelerometers embedded in the cloth and electrically connected to the integrated circuit;

wherein tampering with the article causes a break in one or more of the conducting wires resulting in a loss of current and/or voltage therein or causes accelerations detected by the plurality of accelerometers and thereby causing the integrated circuit logic to activate at least one of the plurality of pre-programmed alerts.

2. The security material as recited in claim 1, further comprising a battery woven into the security cloth for providing power to the security material.

3. The security material as recited in claim 1, further comprising a plurality of reinforcing fibers, each of the plurality of reinforcing fibers being wound around one of the conducting wires.

4. The security material as recited in claim 3, wherein the plurality of reinforcing fibers comprise Kevlar®.

5. The security material as recited in claim 1, wherein the integrated circuit determines that tampering is occurring if one or more of the following occur: a predetermined number of rows and columns of the conducting wires no longer carry current or a set voltage; a predetermined number of the plurality of accelerometers indicates a predetermined number of g impulses or a predetermined number of g's of extended activity; and/or non-battery power to the integrated circuits is terminated.

6. The security material as recited in claim 1, wherein the alert comprises one or more of the following: wireless alert; audio/visual alarm; disablement of power to the article being protected; and/or activation of audio and/or visual recording of the tampering.

7. The security material as recited in claim 1, wherein the plurality of accelerometers are electrically connected to the conducting wire in both directions of a weave of the security cloth.

8. The security material as recited in claim 1, further comprising a connection to provide direct power to the security material.

9. The security material of claim 1, further comprising a transmitter for wireless communication by the integrated circuit to activate at least one of the plurality of pre-programmed alerts.

10. The security material of claim 9, wherein the transmitter comprises a mote.

11. The security material of claim 1, further comprising a global positioning system (GPS) circuit, the GPS circuit being protected by the security material and connected to the integrated circuit and providing location data thereto.

12. The security material of claim 1, further comprising a port, the port attached to the security material for receiving means for programming the integrated circuit.

13. The security material as recited in claim 12, wherein the means for programming comprises one of a computer, a keypad, and a biometric device.

14. An apparatus for connecting two swaths of security material as recited in claim 1, comprising:

a plurality of eyelets formed in a first swath of security material and electrically connected thereto;

a plurality of claws attached to a second swath of security material and electronically connected thereto;

means for rotating the plurality of claws such that each of the plurality of claws is directed through one of the plurality of eyelets; and a plurality of locking slots for retaining a distal end of each of the plurality of claws.

15. The apparatus as recited in claim 14, wherein the means for rotating comprises one of a motor and a finger crank.

16. The apparatus as recited in claim 14, further comprising:

a notch in the distal end of each of the plurality of claws; and a protrusion in the locking slot for engaging the notch when the distal end of each of the plurality of claws is rotated into the locking slot.

17. The apparatus as recited in claim 14, further comprising:

a hole in the distal end of each of the plurality of claws;

a pin in the locking slot; and means for moving the pin into the hole in the distal end of the claw.

18. The apparatus as recited in claim 17, wherein the means for moving the pin comprises one of an electro-active polymer activated piston and an electromagnetic solenoid.

19. An apparatus for connecting two swaths of security material as recited in claim 1, comprising:

a plurality of claws attached to a first swath of security material and electronically connected thereto;

means for rotating the claw such that each of the plurality of claws is directed through the weave of a second swath of security material;

and a plurality of locking slots for retaining a distal end of each of the plurality of claws.

20. An apparatus for connecting two swaths of security material comprising a plurality of woven circuits as recited in claim 1, comprising: a zipper, wherein the zipper comprises a plurality of conducting channels for cross-connecting the woven circuits of the two swaths of security material.

21. The apparatus as recited in claim 20, wherein the woven circuits of the two swaths of material are connected in parallel.

22. The apparatus as recited in claim 20, further comprising a means for locking the zipper.

23. The apparatus as recited in claim 22, further comprising means for opening the means for locking to permit separation of the two swaths of cloth without causing the integrated circuit logic to activate the at least one of the plurality of pre-programmed alerts.

24. An apparatus for connecting two swaths of security material comprising a plurality of woven circuits as recited in claim 1, comprising:

a plurality of holes with a plurality of electrical contact points surrounding each hole;

a plurality of buttons with a plurality of electrical contact points on the bottom of each button;

wherein when each of the plurality of buttons is engaged in each of the plurality of holes, the plurality of electrical contact points on each of the plurality of buttons contact the plurality of electrical contact points surrounding each of the plurality of holes thereby connecting the woven circuits between the two swaths of security material.

25. The apparatus as recited in claim 24, wherein the electrical contact points are spring-loaded.

26. The security material as recited in claim 1, wherein the security material is attached to the protected article by glue.

27. The security material as recited in claim 1, wherein the security material is woven to the protected article.

28. The security material as recited in claim 1, wherein the security material is embedded in the protected article.

29. The security material as recited in claim 1, wherein the security material envelops the protected article.

30. The security material as recited in claim 1, wherein the security material has an adhesive backing for attachment to the protected article.

31. The security material as recited in claim 1, wherein the security material is one of a camouflaged material and a decorative material.

32. The security material as recited in claim 1, wherein the security material can have a plurality of sizes and shapes.

* * * * *